US005778587A

United States Patent [19]

Brandl et al.

[11] Patent Number: 5,778,587

[45] Date of Patent: Jul. 14, 1998

[54] FIRING PIN FOR WEAPON

[75] Inventors: Rudolf Brandl, Dornhan/Weiden; Thomas Romer, Schramberg, both of Germany

[73] Assignee: Heckler & Koch GmbH, Oberndorf am Neckar, Germany

[21] Appl. No.: 798,585

[22] Filed: Feb. 10, 1997

[51] Int. Cl.[6] ..... F41A 17/00

[52] U.S. Cl. ..... 42/70.08

[58] Field of Search ..... 42/70.08

[56] References Cited

U.S. PATENT DOCUMENTS

| | | | |
|---|---|---|---|
| 3,942,278 | 3/1976 | Schaller et al. | 42/70 F |
| 4,011,618 | 3/1977 | Brodbeck et al. | 42/70 F |
| 4,282,795 | 8/1981 | Beretta | 89/148 |
| 4,312,263 | 1/1982 | Bourlet | 89/154 |
| 4,313,274 | 2/1982 | Ludwig et al. | 42/70 F |
| 4,369,593 | 1/1983 | Zedrosser et al. | 42/70 F |

*Primary Examiner*—Charles T. Jordan
*Assistant Examiner*—Meena Chelliah
*Attorney, Agent, or Firm*—Darby & Darby

[57] ABSTRACT

The invention relates to a firing pin and hammer assembly for a fire arm, especially a self-loading fire arm with a closed breech of a submachine gun, the assembly comprising a firing pin capable of being moved from a rest position at which its end is positioned in the travel path of a hammer, to a priming position; a firing pin spring for moving the firing pin into its rest position; a catch (14) capable of being moved by a catch spring engaging the firing pin while the firing pin is in its rest position, and holding the same; and a release assembly cooperating with the hammer and releasing the catch from engagement with the firing pin when the hammer approaches the end of its travel path. The object is to prevent any movement of the firing pin unless the hammer is released. According to the invention, the release assembly is permanently coupled to the hammer for preventing an untimely and excessively forceful operation of the release assembly.

8 Claims, 3 Drawing Sheets

FIRING PIN FOR WEAPON

BACKGROUND OF THE INVENTION

1. Field of the Invention

The invention relates to a firing pin and hammer assembly for a fire arm, especially a self-loading fore arm with a closed breech, having a firing pin capable of being moved from a rest position at which its end is positioned in the travel path of a hammer, to a priming position. Further it includes a firing pin spring for moving the firing pin into its rest position, a catch capable of being moved by a catch spring engaging the firing pin while the firing pin is in its rest position, and holding the same, and a release assembly cooperating with the hammer and releasing the catch from engagement with the firing pin when the hammer approaches the end of its travel path.

In fire arms having a hammer striking a stationary firing pin, there exists the danger that if the loaded weapon is being moved with its breech closed, for example parallel to the direction of the firing pin, and strikes an obstacle, then the firing pin, due to its inertia, would continue its motion and thereby fire the cartridge. Such impact could also be caused by the fire arm dropping down a staircase and bumping into the staircase again and again with different orientation and increasing velocity.

This danger exists in particular with the type of submachine guns where the breech is closed when the trigger is pulled and only a hammer which is separate from the breech, is triggered, since the firing pin in this case has a relatively large mass.

A similarly dangerous situation has also been observed earlier with several automatic weapons where the breech would strike the support end or the cartridge head very hard while the firing pin guided in the breech would continue to keep moving due to the inertia mentioned above. For those weapons, there was proposed (DE-PS 304 280, DE-PS 319 321 and U.S. Pat. No. 2,848,832) to include a spring-mounted catch provided with a release protrusion located proximate to the end of the firing pin being struck by the hammer, for blocking the firing pin in its rest position. The release protrusion is hereby positioned in the travel path of the hammer in such a way that the hammer strikes the release protrusion just before striking the firing pin, thereby overcoming the force of a catch spring and pushing the release protrusion out of the way, thereby releasing the firing pin from the catch.

When, after the shot is fired, the hammer moves again away from the firing pin and the firing pin, as a result, returns to its rest position, the catch again engages and grasps the firing pin.

2. Description of the Related Art

These known safety devices, however, have not proven very effective due to excess stress causing failure after repeated use. Since that time, progress has been made towards reliably preventing the unintended firing of a shot when the weapon is loaded, by sizing the firing pin properly and by dimensioning of the firing pin spring accordingly (this is the spring which urges the firing pin rearwardly).

The inertia forces effecting the firing pin are many times stronger when the weapon hits a concrete floor from the height of several meters, than during the normal loading operation, so that under those circumstances, even a light-weight firing pin and/or a stiff firing pin spring will not be capable of preventing unintended firing. In particular with police weapons intended to be used in densely populated areas, the unintended release of a shot has to be prevented at any cost.

It is a further disadvantage of the known safety devices that the catch may have a relatively large mass causing it to disengage from the firing pin even without being affected by the hammer, mainly as a result of the inertia forces opposing the force of the catch spring locking the catch. At the same time, the large mass of the catch requires a correspondingly stronger catch spring for moving the catch in order to ensure proper firing of the cartridge.

SUMMARY OF THE INVENTION

It is an object of the invention to design a safety device for reliably preventing a shot from being fired solely as a result of inertia forces acting on the firing pin.

The objective is solved by the firing pin and hammer assembly for a fire arm described at the beginning, characterized in that the release assembly is permanently coupled to the hammer.

From the published applications CH 278 022 and DE 21 33 551 B2, there is known a firing pin safety device which, however, is not coupled to the trigger, and the coupling is also not maintained permanently, but is released after each shot and is only reestablished after release of the trigger.

The present invention is distinguished from present state-of-the-art devices where the catch is moved by the hammer during the final short travel path thereof and where the release assembly becomes overly stressed as a result of the high velocity of the catch and the high gear ratio between the hammer motion and the catch motion, in that in the present invention the entire travel path of the hammer is usable, particularly its initial portion where the average velocity of the hammer is still small. Moreover, a rather long portion of the travel path may now be used, whereby notably that end portion with the highest velocity may be excluded from use which, in the past was used exclusively.

It is therefore no longer necessary to utilize only a very short portion of the travel path of the hammer for displacing the catch by a rather substantial distance, but there may even be a step-down gear ratio between the hammer motion and the catch. In addition, a portion of the travel path of the hammer may be used where the hammer is accelerated from its rest position and where its average velocity is relatively small. As a result, the catch may be accelerated gradually to a rather small velocity which the catch spring is capable of cushioning without being damaged even under continuous duty.

Furthermore, there may be provided a permanent tight coupling between the catch and the hammer so that the catch remains in its blocking position even when inertia forces impact the catch.

The coupling between the catch and the hammer also ensures that the catch engages the firing pin reliably and safely when the weapon is charged, i.e. when the hammer is cocked.

It is also possible and sometimes sufficient, instead of providing a tight coupling between the catch and the firing pin, to place the travel path for the catch preferably perpendicular, i.e. cross-wise, to the travel path of the firing pin so that the inertia forces capable of displacing the firing pin from its blocking position do not substantially effect the firing pin. The catch may also be designed to be as light-weight as feasible, with a relatively stiff catch spring, thereby making it even less susceptive to inertia forces.

It is also possible to pivotably attach a coupling rod to the catch and the firing pin for providing a permanent tight coupling therebetween. The kinematic movement of such coupling rod is well defined, but may be adapted to the characteristics of an existing weapon. Alternately, the release assembly may include a radial cam for transmitting the movement of the hammer to the catch.

By using a radial cam, it is possible to match the acceleration between the hammer and the catch in such a way that the catch, the catch spring and the entire release assembly are protected from excess stress, without adversely affecting the movement of the hammer.

The radial cam may also have the form of a shoulder, with a feeler spring-biased thereagainst.

The aforedescribed coupling means (tight coupling, coupling rod and/or radial cam and shoulder, respectively) are preferably designed in such a way that they transmit either only the cocking motion of the hammer or only the striking motion thereof or both these motions to the catch. Transmission of the cocking motion forces the safety catch to lock. By transmitting the striking motion, a suitable step-down ratio—depending which portion of the hammer travel path is used—between the hammer and the catch for releasing the safety catch can be selected.

In order to ensure that the release assembly does not become decoupled from the hammer as a result of the inertia forces, the means for transmitting the hammer motion to the catch is formed as a sliding groove disposed on the hammer. A feeler adapted for movement in the sliding groove is guided bilaterally by the flanks thereof and is consequently not capable of departing from the groove even if inertia forces are present.

As described, it may be possible to couple the hammer directly to the catch; while an arrangement of this type may be feasible with a drop barrel weapon, it can, however, not be realized with most weapons having a movable breech, since the breech has to be movable in relation to the hammer even if the hammer itself does not move.

In another embodiment of the invention, it is therefore proposed that the release assembly includes a pivotably supported control lever coupled to the hammer, the control lever acting on the catch in a direction opposing the catch spring and movable between two positions, namely in a release end position wherein the catch biased by the control lever releases the firing pin, and a safety end position wherein the control lever releases the catch, so that the catch is urged by the catch spring into locking engagement with the firing pin.

The control lever is movably secured to the grip or housing of the weapon and effects the catch disposed in the breech when the breech is in its closed position. When the breech is opened, the catch moves away from the control lever and immediately engages the firing pin, thereby holding the latter securely when the breech is again closed.

In may, in principle, be feasible that the control lever itself is guided in the sliding groove of the hammer. Preferably, however, a rocker, with its free end guided in the sliding groove, is pivotably supported on the control lever. As a result, coupling between the hammer motion and the control lever motion is restricted, obviating the need for these parts to be arranged proximate to each other. This permits less restrictive design criteria, thereby enabling the use of relatively light-weight components and preventing undue deceleration of the striking hammer by the release assembly of the invention.

The free end of the rocker is preferably provided with a feeler guided in the aforedescribed sliding groove. The front portion of the sliding groove which is associated with the firing pin and consequently also with the control lever located below or next the firing pin, is preferably closed so that the control lever can be—positively and, if necessary, forcibly—disengaged from the catch when the hammer returns to its cocked position; in this way, the firing pin is always secured in the abovedescribed manner when the weapon is cocked.

In the release assembly of the invention, the entire travel path of the hammer or a suitable portion thereof may be used for releasing the firing pin.

If the components forming the release assembly have a relatively large mass, it may be advantageous, as mentioned above, to use the relatively low initial velocity of the hammer for releasing the firing pin.

Since, according to the last described embodiment, the invention enables the components of the release assembly to have a particularly low mass, it is advantageous to use only the last portion of the travel path of the hammer for releasing the firing pin, thereby blocking the firing pin as long as possible. This ensures that in spite of the wear which may manifest itself after the weapon equipped with the invention is used for many years under extreme conditions and without proper maintenance, the release assembly of the invention is still reliably securing the firing pin as long as the hammer is locked in the cocked position.

It is possible that although the release assembly is operative only briefly, its operation is not abrupt, but rather smooth and gradual as the result of a suitable design of the sliding groove.

In accordance with another embodiment, the catch is formed as a bilaterally guided slider adapted for movement cross-wise to the firing pin and provided with an opening enclosed on all sides, which opening is penetrated by the firing pin and capable of catching behind a protrusion or a recess in the firing pin.

A slider of this type can, because of its frame-like shape, be designed very light-weight in spite of the stability and reliability required for holding the firing pin, which is particularly advantageous for the reasons discussed above.

When, moreover, the control lever presses against the slider for urging the latter out of its blocking position, then the firing pin is seated against the side of the opening facing away from the control lever; in this position, the slider may be firmly guided next to the seated firing pin, so that the slider will not be subjected to bending forces, but rather to shear forces by the inertia forces acting on the firing pin.

Finally, the slider is movable in a direction essentially perpendicular to the travel direction of the firing pin. Consequently, if inertia forces were capable of moving the slider when the weapon is striking an object hard, these inertia forces will not be capable of moving the firing pin. Furthermore, the inertia forces would have to be rather large to be capable of significantly displacing the light-weight spring-mounted slider.

Upon reaching its release end position, the slider may be decelerated by compressing the slider spring which returns the slider to its blocking position.

In order to prevent the slider spring from fatiguing over time as a result of the frequent complete compression, the slider is provided with a stop for accurately defining the release end position thereof. This does not only provide protection for the slider spring, but enables the opening in the frame-like slider to be as small as possible and, consequently, the slider to be as light-weight as possible.

Since, as a result, the slider is now secured in its release position between its stop and the control lever, the slider is no longer capable of recoiling from the stop after having reached its release end position, fluttering and thereby jeopardizing the safe firing of a shot.

Further more, the slider spring is seated on the widened end of a spring guide pin, with the length of the slider spring selected such that the slider spring is capable of being compressed further after reaching the release end position, until it stops on the spring support face facing away from the widened end, thereby successfully preventing complete compression of the slider spring.

Overall, the invention provides a safety device for a firing pin, the device being capable of holding the firing pin safely even when the weapon is dropped to the floor, and releasing the firing pin only just prior to being struck by the hammer. The safety device for a firing pin according to the invention is robust and reliable, even when the respective weapon is not well maintained over an extended period of time, while still being used frequently during that time.

If the rocker or the control lever is accidentally not installed during maintenance of the weapon, then the weapon cannot be fired. The slider preferably assumes the role of the firing pin holder, meaning that the firing pin is not gripped in case the slider was left out during maintenance of the weapon.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
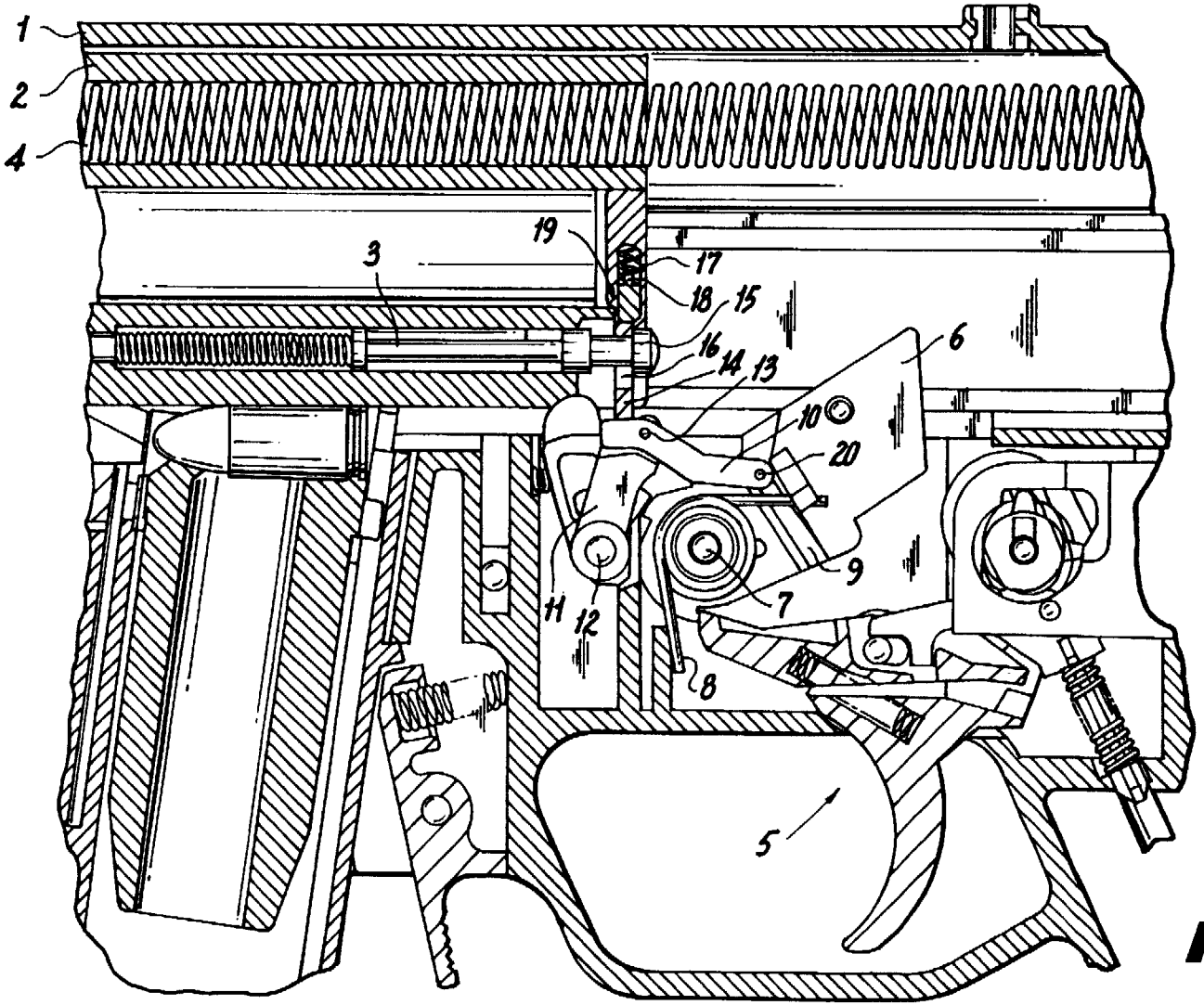
FIG. 1 is a submachine gun according to the invention with cocked hammer and blocked firing pin.

All figures show basically the same respective view, however, under different operating conditions; for better clarity, not all reference numbers are shown in one or all of the figures, but are distributed over the figures; the reference numbers, however, apply to all figures.

In the following, the term "upward" description shall mean "upward in the drawing," and "forward" means "to the left in the drawing;" other descriptions of positions, such as "on top," "behind" or the like, follow accordingly.

The partial elevation of a submachine gun as depicted in the figures shows a weapon housing 1 with a breech 2 movably supported therein, with the breech 2 biased by a recoil spring 4 in the direction of its illustrated closed position.

The depicted submachine gun is designed so that the breech 2 is closed in its ready-to-fire position, meaning that the breech 2 is positioned farthest to the left (FIG. 1).

The breech 2 is penetrated lengthwise by a firing pin 3 provided at its rearward end with an end flange 15.

The firing pin 3 is biased by a firing pin spring (not shown) in such a way that the rearward (in the figure right) end of its end flange 15 protrudes from the breech 2, when the firing pin 3 is in its rest position.

In the weapon housing 1, there is further disposed a trigger assembly 5 including a trigger 21 and a hammer 6. The hammer 6 is pivotably supported by a hammer axis 7 oriented normal to the surface of the figure and biased by a main spring 8 in one direction (in the drawing counter-clockwise).

The hammer 6 is positioned in such a way that it is moved—after each shot—by the recoil motion of the breech 2 into the position shown in FIG. 1, counteracting the main spring 8, whereafter the breech 2 closes again. When the trigger 21 is pulled, then the hammer 6 is released through the action of the main spring 8, strikes the rearward end of the firing pin 3 protruding from the breech 2 (shown in FIG. 3), thereby thrusting the firing pin 3 forward. Due to its mass, the firing pin 3 now moves farther forward, counteracting the firing pin spring (not shown), until it strikes the igniter of a cartridge on which the breech is resting. Firing of this cartridge throws the breech 2 rearwardly, and the described actions are repeated, until the trigger 21 is released and the trigger assembly 5 with the hammer 6 remains in the position shown in FIG. 1 and all cartridges are spent.

In the breech 2 there is also disposed a slider 14 which is movably guided in a direction perpendicular to the travel direction of the firing pin 3. The slider 14 is formed in the shape of a small rectangular frame having an opening 16 which is penetrated by the firing pin 3. The opening 16 may be round, oval or rectangular with a diameter or a width, respectively, which is at least somewhat larger than the diameter of the end flange 15 of the firing pin 3.

Figure 2:
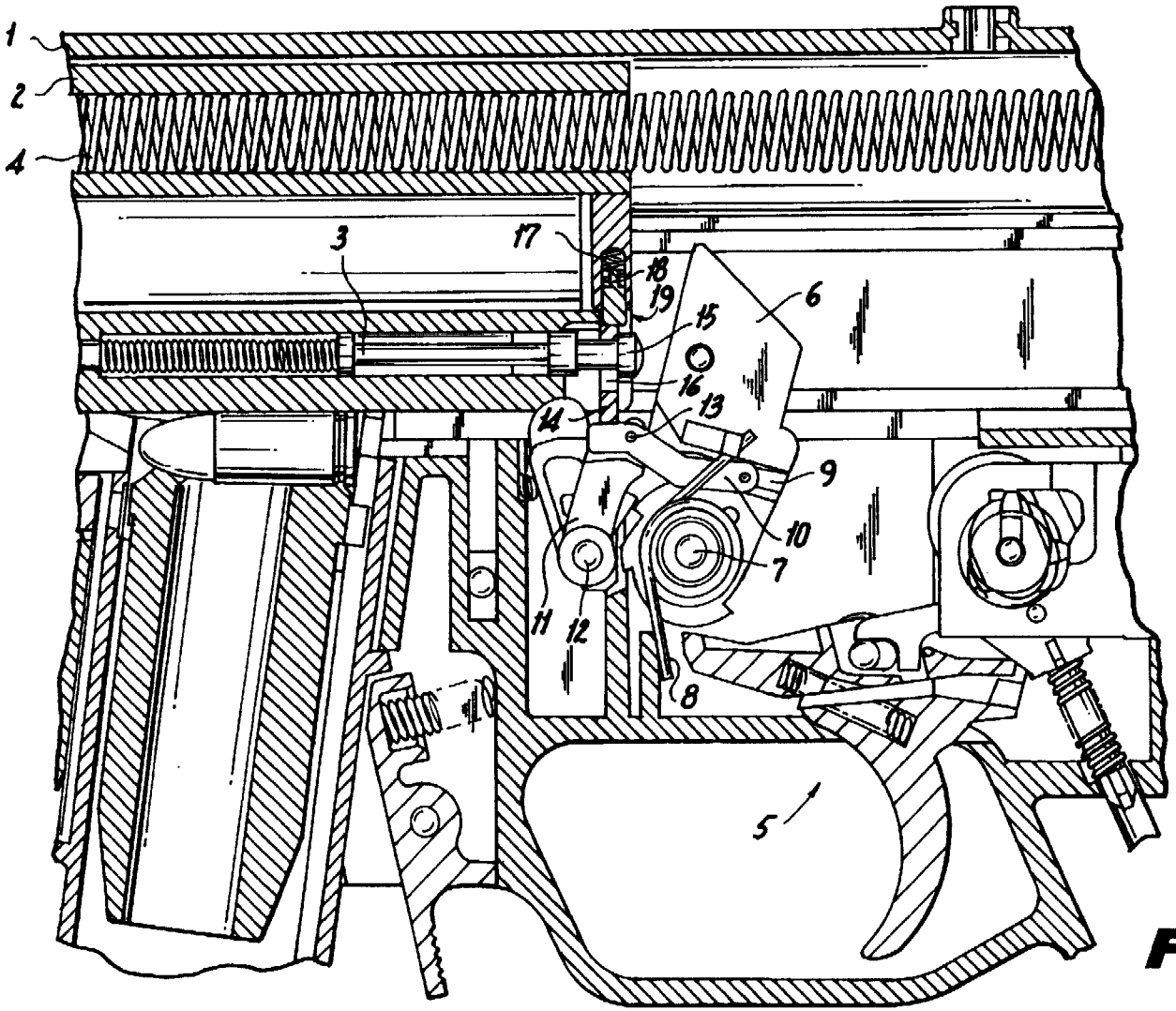
FIG. 2 shows an almost released hammer, just before the firing pin is released.
Figure 3:
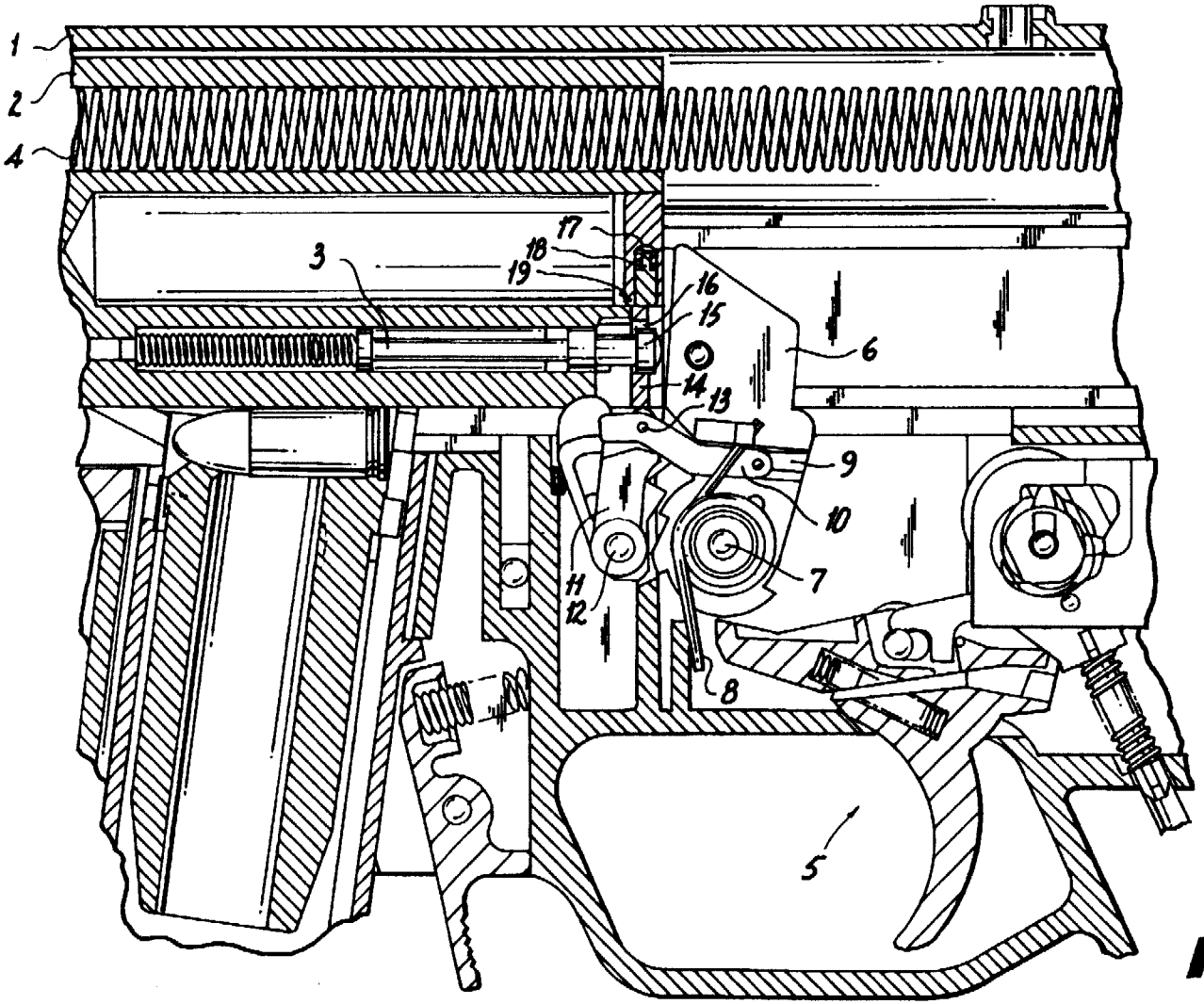
FIG. 3 shows a released hammer and released firing pin.

The slider 14 is movable between a blocking position (FIGS. 1 and 2) and a release position (FIG. 3). In the blocking position or lower position, the edge of the slider 14 engages behind the end flange 15. The firing pin 3 is here in its rest position. In the release position or upper position, the end flange 15 is positioned exactly behind the opening 16 and is capable of moving into or through the same.

In the release position, the slider 14 rests against a limit stop 19 disposed thereabove and defining the release position.

In the breech 2 above the slider 14, there is positioned a bore extending parallel to the travel direction of the slider 14. The bore is adapted to accept a slider spring 17 formed as a helical coil with a spring guide pin 18 extending therethrough. The slider spring 17 is supported on its one end by the bottom of the bore and on its other end by the concealed end of the spring guide pin 18, with the free end of the spring guide pin 18 resting on the opposing edge of the slider 14. The length of the spring guide pin 18 is dimensioned in such a way that it seats on the bottom of the bore before the slider spring 17 is completely compressed. This prevents damage to the spring 17.

Below the slider 14 and displaced somewhat towards the front and at about the same height as the hammer axis 7, there is disposed parallel to the hammer axis 7 a control lever axis 12 for pivotably supporting a control lever 11 is at its lower end. The upper end of the control lever 11 is provided with a radial cam sloping upward from front to rear and contacting the lower surface of the slider 14 seated thereon. The slider 14 is biased against the radial cam by the slider spring 17.

The control lever 11 is pivotable between a blocking position (FIGS. 1 and 2) in which it is slightly inclined rearwardly, and an almost vertical release position (FIG. 3). Because the radial cam slopes upward, the slider 14 assumes its lower blocking position when the control lever 11 is pivoted rearwardly in its blocking position, and the slider 14 assumes its release position when the control lever 11 is pivoted forwardly into its almost vertical position.

The hammer 6 is provided with a sliding groove 9 adapted for accepting a feeler 20 movable disposed therein, with the feeler 20 made of sheet metal and formed or disposed at the rear end of a rocker 10. The rocker 10 is pivotably supported at its forward end by a pin 13 attached near the upper end of the control lever 11.

A comparison of the three figures shows that the sliding groove 9 is formed in such a way that is permits the following sequence of motions:

When the hammer 6 is cocked, i.e. turned clockwise (in accordance with the drawing) into the position depicted in FIG. 1, then the front end of the sliding groove 9 hits the feeler 20, pulling it rearwardly; the feeler 20 then pulls the rocker 10 rearwardly, thereby turning the control lever 11 clockwise into the position shown in FIGS. 1 and 2. The radial cam at the upper surface of the control lever 11 enables the slider 14 to be pushed downwardly by the slider spring 17, thereby preventing the control lever 11 from turning in the opposite direction even if the control lever 11 were able to turn freely.

As a result, the firing pin 3 is now engaged in the slider 14 positioned in its lower blocking position and thus prevented from moving forward.

When the trigger 21 is pulled (with cocked hammer—FIG. 1), then the hammer 6 is released, moving counterclockwise aided by a strong main spring. In this situation, the feeler 20 moves passively along the sliding groove 9, so that the hammer 6 does not affect the rocker 10 and consequently the control lever 11 which thus remains in its previous positions.

Just before reaching the rear end of the firing pin 3, the hammer 6 strikes the control lever 11 and turns it counterclockwise into the position shown in FIG. 3. The radial cam at the upper surface of the control lever 11 urges the slider 14 upwardly, counteracting the force of the slider spring 17. As a result, the slider releases the firing pin 3 whose rear end is struck by the hammer 6 immediately thereafter.

After the shot is fired, the breech 2 slides rearwardly (in the drawing to the right), riding over the hammer 6 and moving it into the cocked position shown in FIG. 1, thereby returning the control lever 11 to its safety position (FIG. 1 and FIG. 2).

During the return travel of the breech 2, the slider 14 was again able to move downwardly—urged by the slider spring 17—and to block the firing pin 3. When the breech 2 again reaches its forward end position shown in FIG. 1 (the weapon is then loaded and cocked), then the control lever 11 is already positioned in such a way that the slider 14 is left in its lower position.

In accordance with a modification of an embodiment, the sliding groove 9 may also be shaped in such a way that it prompts the control lever 11 to move into its release position (FIG. 3). The hammer 6 does then no longer have to strike the control lever 11 in the manner described above.

As a result of the coupling between the control lever 11 and the hammer 6, the control lever 11 is forced into its safety position; the aforedescribed coupling may be expanded by having the hammer 6 strike the control lever 11 or by a suitable design of the sliding groove 9.

The described embodiment is designed for continuous duty since the parts of the release assembly moved by the hammer 6 and the slider 14 are very light-weight and the slider spring 17 does not exert an excessive restoring force on the slider 14.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A firing pin and hammer assembly for a fire arm comprising:

(a) a firing pin capable of being moved from a rest position to a priming position, the firing pin having an end, the end is positioned in the travel path of a hammer;

(b) a firing pin spring for moving the firing pin into its rest position;

(c) a catch capable of being moved by a catch spring engaging the firing pin while the firing pin is in its rest position, and holding the same; and (d) a release assembly cooperating with the hammer and releasing the catch from engagement with the firing pin when the hammer approaches the end of its travel path and wherein the release assembly is permanently coupled to the hammer.

2. The firing pin and hammer assembly for a fire arm according to claim 1, wherein the release assembly further comprises means for transmitting one of a cocking motion and a release motion of the hammer to the catch.

3. The firing pin and hammer assembly for a fire arm according to claim 2, wherein the motion transmitting means is a sliding groove disposed in the hammer.

4. The firing pin and hammer assembly for a fire arm according to claim 1, wherein the release assembly further comprises a pivotably supported control lever coupled to the hammer, the control lever acting on the catch in a direction opposing the catch spring and movable between a release end position wherein the catch biased by the control lever releases the firing pin, and a safety end position wherein the control lever releases the catch, so that the catch is urged by the catch spring into locking engagement with the firing pin.

5. A firing pin and hammer assembly for a fire arm comprising:

(a) a firing pin capable of being moved from a rest position to a priming position, the firing pin having an end, the end is positioned in the travel path of a hammer;

(b) a firing pin spring for moving the firing pin into its rest position;

(c) a catch capable of being moved by a catch spring engaging the firing pin while the firing pin is in its rest position, and holding the same; and (d) a release assembly cooperating with the hammer and releasing the catch from engagement with the firing pin when the hammer approaches the end of its travel path and wherein the release assembly is permanently coupled to the hammer;

(e) a rocker having a free end, the free end is guided in a sliding groove, and is pivotably supported on a control lever;

wherein the release assembly further comprises a pivotably supported control lever coupled to the hammer, the control lever acting on the catch in a direction opposing the catch spring and movable between a release end position wherein the catch biased by the control lever releases the firing pin, and a safety end position wherein the control lever releases the catch, so that the catch is urged by the catch spring into locking engagement with the firing pin.

6. The firing pin and hammer assembly for a fire arm according to claim 5, wherein the catch is formed as a slider adapted for movement cross-wise to the firing pin, the slider provided with an opening penetrated by the firing pin and seated on the control lever, and whereby the opening engages behind a transverse feature in the firing pin, when the slider is in the safety end position, and releases the firing pin for longitudinal movement, when the slider is in the release end position.

7. The firing pin and hammer assembly for a fire arm according to claim 6, wherein the slider, in its release end position, is moved by the control lever against a stop which defines the release end position.

8. The firing pin and hammer assembly for a fire arm according to claim 7, wherein the catch spring is seated on a spring guide pin which has a greater length than the greatest possible compression of the catch spring and a widened end resting against the slider.

* * * * *